US006393796B1

(12) United States Patent
Goettl et al.

(10) Patent No.: US 6,393,796 B1
(45) Date of Patent: May 28, 2002

(54) BATTEN ELEMENTS FOR SECURING TILES TO A ROOF AND METHOD OF MAKING THE BATTENS

(76) Inventors: George M. Goettl, 4329 E. Highland Dr., Paradise Valley, AZ (US) 85253; Danny L. Koble, 14001 N. 35th Dr., Phoenix, AZ (US) 85053; Robert L. Koble, Jr., 1898 Pearl Dr., Camp Verde, AZ (US) 86322

( * ) Notice: Subject to any disclaimer, the term of this patent is extended or adjusted under 35 U.S.C. 154(b) by 0 days.

(21) Appl. No.: 09/726,254

(22) Filed: Nov. 30, 2000

(51) Int. Cl.[7] ..... E04C 3/30; E04D 1/34

(52) U.S. Cl. ..... 52/733.2; 52/551; 52/483.1; 52/302.1

(58) Field of Search ..... 52/551, 549, 508, 52/506.06, 731.7, 733.2, 304.1, 302.3, 302.6, 483.1, 480, 478; D25/164, 119

(56) References Cited

U.S. PATENT DOCUMENTS 1,163,034 A * 12/1915 Phippen
2,361,112 A * 10/1944 Llewellyn
3,353,316 A * 11/1967 Berg
3,477,187 A * 11/1969 Fruman
3,681,881 A * 8/1972 Baran
5,471,807 A * 12/1995 Vasquez
5,570,555 A * 11/1996 Ferguson et al.
5,794,396 A * 8/1998 Gibbs
6,226,949 B1 * 5/2001 Huber

* cited by examiner

*Primary Examiner*—Robert Canfield
(74) *Attorney, Agent, or Firm*—H. Gordon Shields

(57) ABSTRACT

Batten elements are made of plastic or metal, such as galvanized steel, galvalume, or aluminum. Several alternate embodiments of battens are shown, along with a schematic illustration of a punch process for making the metal battens of the present invention. The batten elements all include holes or tunnels for the drainage of water through the batten elements. The alternate embodiments are shown in cross section or end view.

11 Claims, 2 Drawing Sheets

BATTEN ELEMENTS FOR SECURING TILES TO A ROOF AND METHOD OF MAKING THE BATTENS

BACKGROUND OF THE INVENTION

1. Field of the Invention

This invention relates to batten elements secured to a roof and which in turn are used to secure tiles to a roof and, more particularly, to batten elements made of metal or plastic and to a method of making the battens.

2. Description of the Prior Art

U.S. Pat. No. 1,163,034 (Phippen) discloses binding strips for roofs. While the binding strips perform a different function from battens currently used on tile roofs, they disclose a cross section or configuration with channels on the bottom of the strips to provide for the runoff or draining of water.

U.S. Pat. No. 4,437,283 (Benoit) discloses a single ply roofing system which includes the use of rectangular battens. Such rectangular battens are typical of the prior art.

U.S. Pat. No. 4,445,306 (Schauffele) discloses a roofing system in which a plastic bar, or batten, with a curved top portion is used to help hold a flexible waterproof membrane in place on a roof.

U.S. Pat. No. 4,662,141 (Miko) discloses a roofing system which utilizes a rectangular, wooden lattice (batten) to help secure concrete roofing panels to a roof.

U.S. Pat. No. 4,718,211 (Russell & Tubbesing) discloses a plastic batten to help secure a membrane to a roof.

U.S. Pat. No. 5,060,445 (Jong) discloses a roofing system which employs wooden batten elements having a generally rectangular cross sectional configuration, typical of the prior art.

U.S. Pat. No. 5,161,342 (Hasan et al) discloses the use of plastic batten strips having a generally rectangular cross sectional configuration in a membrane-based roofing system.

U.S. Pat. No. 5,197,252 (Tiscareno) discloses the use of extender elements with typical rectangular wooden battens of the prior art for a tile roof.

U.S. Pat. No. 5,471,807 (Vasquez) discloses roof battens for tile roofs, and the battens have grooves in their bottom side to allow water to drain through the battens. The batten of the '807 patent may be made of plastic or wood, and their cross sectional configuration is generally rectangular.

Roof battens in contemporary use are typically scrap lumber 1" by 2" elements. The manufacturers of the batten elements typically do not take time to place grooves on the underneath side for the draining of water. Neither do the roofers, who apply the battens and use them for fastening tiles, take the time to put the grooves on the bottom. Accordingly, water that gets behind the battens collects and eventually rots the tar paper/felt and wooden battens. This in turn leads to leaky roofs.

The wooden battens of the prior art, and also plastic battens of the prior art, both having a generally rectangular configuration, have an obvious problem of being difficult to store in quantities since their cross sectional configuration prevents nesting. They are accordingly simply stacked like lumber is stacked.

The battens of the present invention are stackable or nestable and thus conserve space and are easily transported. The battens of the present invention are primarily illustrated as being made of metal, but they also may be made of plastic, or the like. Holes are punched through them for water drainage. Since they are not made of wood, there is no warpage, curling, splitting, expanding, contracting, etc., and they are made of recyclable material. They are essentially waterproof, will not rot, mildew, or gain weight by absorbing water. They are easily secured to a roof and receive tile elements easily and conveniently.

SUMMARY OF THE INVENTION

The invention described and claimed herein comprises batten elements for securing roof tiles to a roof. The batten elements have a cross sectional configuration which may be described as a generally inverted vee having a pair of outwardly extending flanges. The flanges are disposed on the roof. Holes extend through the flanges and adjacent portions of the inverted vee portions to allow for the draining of water. Different cross sectional configurations are illustrated, and an embossed or "stucco" finish is also illustrated. The "stucco" embossment helps to prevent nails, used to secure the tiles to the battens and to the roof, from wandering. Moreover, the "stucco" embossment strengthens the steel to the equivalent one gauge in thickness. For manufacturing battens made of steel, a punch process is disclosed. The punch or die and press process may be used for manufacturing the battens from coils or sheets of galvanized steel, galvalume, aluminum, or other appropriate metal, or the battens, if made of a plastic material, may be appropriately molded.

Among the objects of the present invention are the following:

- To provide new and useful batten strips;
- To provide new and useful batten strips made of metal;
- To provide new and useful batten elements having a generally inverted vee configuration with outwardly extending flanges;
- To provide new and useful battens made by a punch process;
- To provide a new and useful method of making a metal batten;
- To provide new and useful battens made of a plastic material; and
- To provide new and useful batten strips having elements formed therein to prevent nails from wandering as tiles are secured to the batten strips and to a roof.

DESCRIPTION OF THE PREFERRED EMBODIMENT

Figure 1:
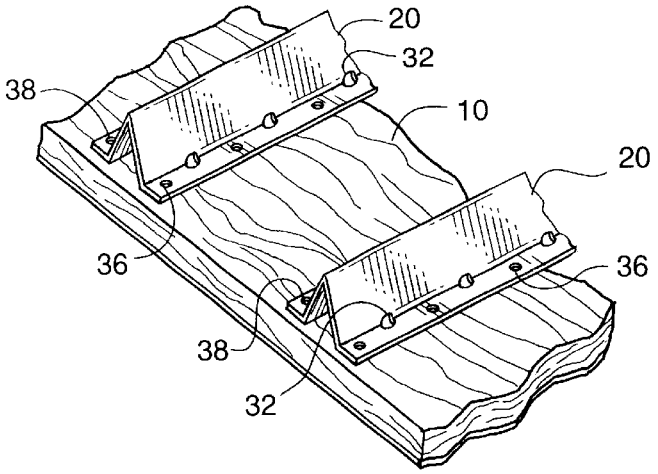
FIG. 1 is a perspective view of a roof showing battens of the present invention disposed thereon.

FIG. 1 is a perspective view of a roof 10 showing a plurality of battens 20 secured thereto. The roof and battens are now ready for tiles to be secured to the battens 20 and to the roof 10. Note that, for purposes of clarity, tar paper, or "felt" or other water proofing membrane, etc., has been omitted from FIGS. 1 and 7.

Also shown in FIG. 1 are water drain holes 32, discussed below, and nail holes 36 and 38. The nail holes 36 and 38 may be used to secure a batten 29 to the roof 10. The nail holes 36 and 38 are staggered from the drain holes 32, shown in FIG. 1, and the drain holes 32 and 34, shown in FIG. 2.

FIGS. 2, 3, 4, 5, and 6 illustrate various configurations of the battens of the present invention. The drawing figures will be discussed sequentially.

Figure 2:
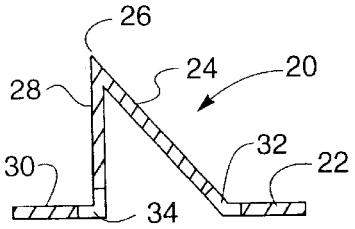
FIG. 2 is a view in partial section of a batten of the present invention.

FIG. 2 is a view in partial section of a batten 20. The batten 20 includes a pair of outwardly extending flanges 22 and 30, with a pair of generally inverted vee shaped arms 24 and 28 disposed between the flanges 22 and 30. The arm 24 extends upwardly from the flange 22 to which it is secured to a ridge 26. Arm 28 extends downwardly from the ridge 26 to the flange 30. The angle between the arm 26 and the flange 28 is substantially a right angle, while the angle between the flange 22 and the arm 24 is an obtuse angle, and substantially acute from the vertical.

For allowing water to drain through the batten 20, there are a plurality of aligned holes, including holes 32 and 34. The hole 32 is disposed at the juncture of the flange 22 and the arm 24, and the hole 34 is disposed at the juncture of the flange 30 and the arm 28. This is also shown in FIG. 1.

As stated above, the nail holes 36 and 38 are staggered from the nail holes 32 and 34, as shown in FIG. 1. The nail holes 36 and 38 extend through the flanges 22 and 30, and are shown in FIG. 1.

Figure 3:
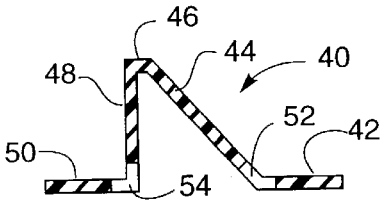
FIG. 3 is a view in partial section of an alternate embodiment of a batten of FIG. 2.

The batten 20 may be made of metal or a relatively hard plastic, as convenient. While the cross hatching in FIG. 2 illustrates metal, the cross hatching in FIG. 3 indicates plastic. FIG. 3 is a view in partial section of another batten 40. The cross sectional configuration of the batten 40 is slightly different from the cross sectional configuration of the batten 20.

The batten 40 includes a flange 42 extending outwardly from an arm 44. Another flange 50 extends outwardly from an arm 48. The angular orientations between the flange 42 and the arm 44 and the flange 50 and the arm 48 are substantially the same as discussed above in conjunction with the batten of FIG. 2 and its corresponding elements. However, where the batten 20 includes a relatively sharp top ridge 26 at the juncture of the arms 24 and 28, the batten 40 includes a relatively flat top portion 46.

The arms 44 and 48 extend downwardly from the generally flat top portion 46.

Two water drain holes 52 and 54 are illustrated in FIG. 3. The drain hole 52 is at the juncture of the flange 42 and the arm 44, and the drain hole 54, aligned with the drain hole 52, is disposed at the juncture of the arm 48 and the flange 50. It will be noted that the aligned drain holes in both the batten 20 and the batten 40 extend onto both the flanges and their adjacent arms to assure complete water drainage.

Figure 4:
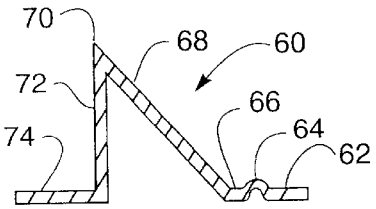
FIG. 4 is a view in partial section showing another cross sectional configuration of the battens of the present invention.

A batten 60 is shown in cross section in FIG. 4. The batten 60 has a slightly different cross sectional configuration from the battens 20 and 40 of FIGS. 2 and 3, respectively.

The batten 60 includes a flange 62 and an arm 68, with a ripple 64 at the adjacent to, or between, the flange 62 and the arm 68. The ripple 64 defines a nail retaining trough 66. The trough 66 insures that a nail driven downwardly and contacting the arm 68 will not move or veer away from the batten 60, but will then penetrate the trough 66 in order to secure a tile to the batten 60 and to the roof on which the batten 60 is disposed.

The arm 68 extends upwardly from the flange 62 and trough 66 to a ridge 70, and an arm 72 extends downwardly from the ridge 70 to a flange 74. Once again, the flanges 62 and 74 extend outwardly aligned with each other, as with the other battens discussed above. The angular orientations between the flange 62 and the arm 68 and the flange 74 and the arm 72 are fundamentally the same as described above and as illustrated for the battens 20 and 40 of FIGS. 2 and 3, respectively.

It will be noted that drain holes for the batten 60 are not illustrated in FIG. 4 in order to show the ripple 64 and the trough 66. However, it will be understood that the batten 60 also includes a plurality of aligned drainage holes, such as discussed above for the battens 20 and 40 of FIGS. 2 and 3, respectively. The drainage holes may also penetrate the ripple 64 and the trough 66 in order to assure proper water drainage.

Figure 5:
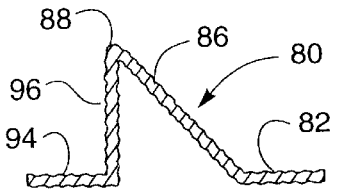
FIG. 5 is an end view of another batten of the present invention.

FIG. 5 is an end view of a batten 80 which has what is referred to as a stucco finish, as opposed to the generally smooth finishes illustrated for the battens 20, 40 and 60 of FIG. 2, 3, and 4, respectively. The batten 80 includes a pair of outwardly extending and aligned flanges 82 and 94. The flanges 82 and 94 extend outwardly from a pair of arms 86 and 90, respectively. At the juncture of the arms 86 and 90 is a ridge 88. In the end view of the batten 80, drain holes are not illustrated, but, as with the other battens discussed above, the batten 80 also includes a plurality of aligned drainage holes.

The purpose of the "stucco" finish of the metal out of which the batten 80 is made is for essentially the same purpose as the ripple 64 and trough 66 of the batten 60, namely to insure that a nail impinging on the arm 86 will move downwardly and get caught in one of the pockets of the stucco finish and will accordingly be driven through the batten 80, and preferably close to the juncture of the flange 82 and the arm 86. This insures a clean and proper securement of a file to the roof on which the batten 80 is disposed.

Again, the angular orientations of the arms and flanges are the same as discussed above, and also the same as for the battens discussed below.

Figure 6:
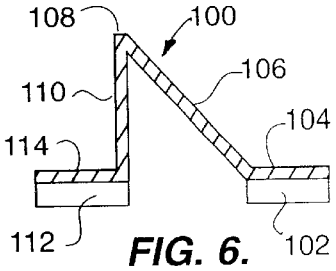
FIG. 6 is a view in partial section of another batten configuration of the present invention.

Still another batten embodiment is illustrated in FIG. 6. FIG. 6 is a view in partial section through a batten 100 illustrating an alternate type of drainage structure. Rather than the holes, as illustrated in FIGS. 2 and 3, the batten 100 of FIG. 6 includes what are essentially tunnels extending through flanges. The batten 100 includes a flange 102 which extends outwardly from an arm 106. A tunnel 104 is formed in the flange 102 and in the adjacent portion of the arm 106. The arm 106 extends upwardly to a ridge 108, and an arm 110 extends downwardly from the ridge 108. The arm 110 extends to a flange 114. A tunnel 112 extends through the flange 114 and through the adjacent portion of the flange 114. It will be noted, as indicated, that the tunnels 104 and 112 extend through the adjacent portions of the arms 106 and 110, as well as through the flanges 102 and 114.

A plurality of aligned tunnels will extend through the flanges and adjacent arms, just as a plurality of aligned holes extend through the battens 20 and 40, as illustrated, and as will also be understood to extend through the battens 60 and 80.

The ripple and trough 64, 66 configuration of FIG. 4 lends itself better to drainage holes than to the tunnel configuration illustrated in FIG. 6, but the tunnel drainage may also be used. Moreover, the stucco finish of the batten 80 of FIG. 5 may include either holes or tunnels, as desired, but may preferably include holes.

Figure 7:
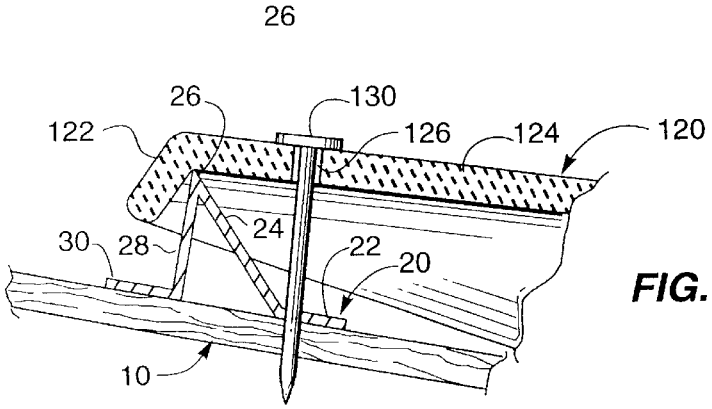
FIG. 7 is a schematic illustration showing a batten of the present invention in its use environment.

The employment of the battens of the present invention are illustrated in FIG. 7. FIG. 7 is a view in partial section through the roof 10 showing a batten 20 secured thereto. The batten 20 is appropriately secured to the roof 10 by fasteners, such as nails or staples, not shown, and a tile 120 is illustrated as disposed over the batten 20. The tile 120 includes a lip 122 which is disposed over the ridge 26. The lip 122 extends downwardly and outwardly from a main portion 124 of the tile 120. A nail hole 126 extends through the main body portion 124, and a nail 130 is shown extending through the nail hole 126 and through the flange 122 of the batten 20 and into the roof 10. The nail 130 accordingly secures the tile 120 to the batten 20 and to the roof 10.

Figure 8:
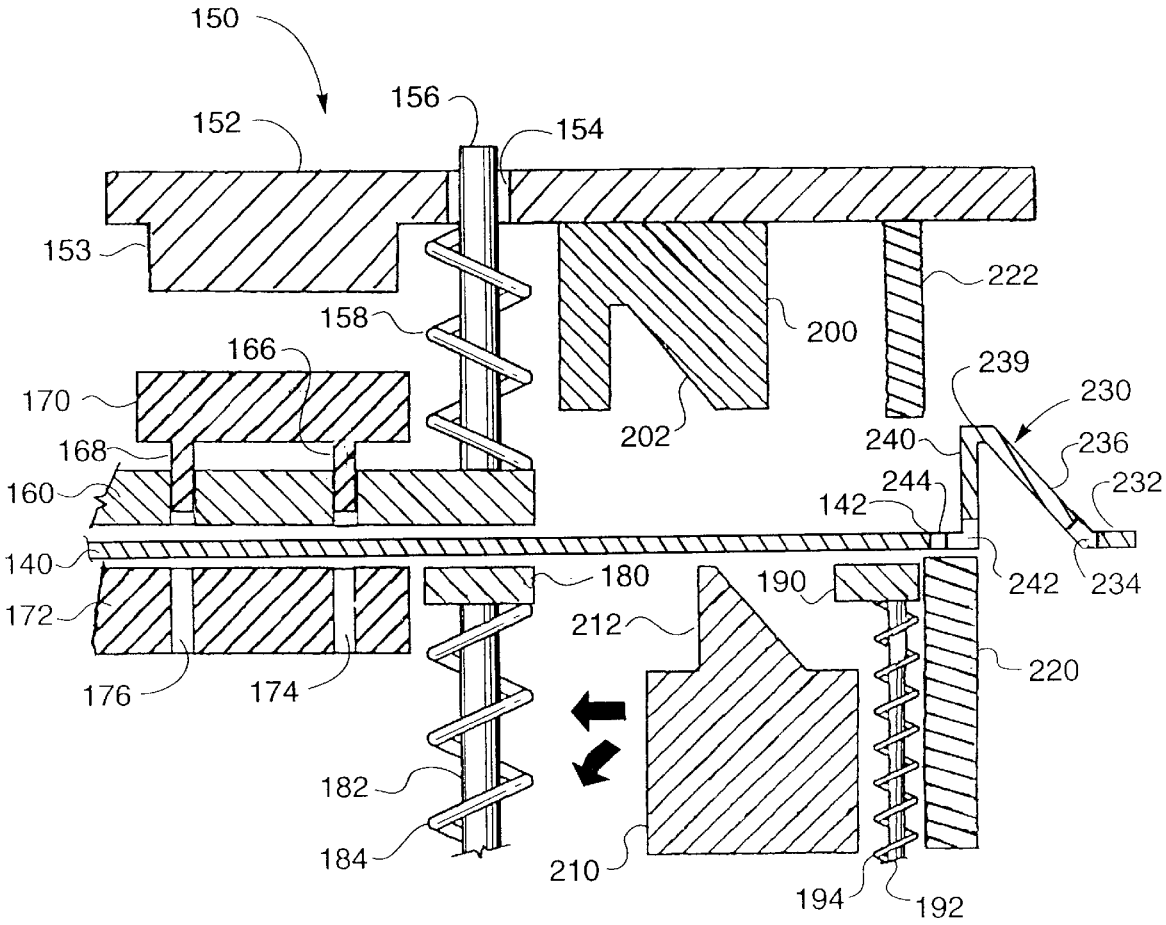
FIG. 8 is a schematic illustration of a punch process used to manufacture some of the battens of the present invention.

FIG. 8 is a schematic representation of a method used to manufacture the battens of the present invention. The process may be referred to as a punch process in which battens are sequentially formed from either sheets of material or coils of material. The punch process is, of course, primarily applicable to the use of metal for the battens, such as steel or aluminum, or the like. Battens made of plastic will be appropriately molded, or the like. For the following discussion, attention will be directed primarily to FIG. 8

Raw material, such as galvanized steel, as from a sheet, or preferably from a coil, is fed into press apparatus 150. The raw material is indicated in FIG. 8 by reference numeral 140. Since the punch process is a continuous one, three battens are schematically shown in FIG. 8, moving from left to right in the Figure.

The press apparatus 150 includes a press plate 152, with a boss 153 extending downwardly from the plate 152. Adjacent to the boss 153 is a bore 154 through which the upper portion of a spring pin 156 extends. Below the plate 152, and disposed about the pin 156, is a compression spring 158.

The lower portion of the pin 158 is secured to a stripper plate 160. The stripper plate 160 includes a pair of bores through which extend a pair of hole punches 166 and 168. The punches 166 and 168 are secured to a punch plate 170. The boss 153 contacts the plate 170 as the press plate 152 moves downwardly.

A female punch plate 172 is disposed beneath the stripper plate 160 and beneath the material 140. The plate 172 includes a pair of bore which receive the pins 166 and 168. The holes punched in the material 140 are, of course, the drain holes for a finished batten.

Aligned with the pin 156 and its spring 158 is a spring plate 180 with a pin 182 secured thereto. A compression spring 184 is disposed about the pin 182. The spring pins and their compression springs help to move the respective elements back to their positions indicated in FIG. 8 after a punch stroke has been made.

While the drain holes are being punched in the material for the first batten, the second batten is having its flanges and arms formed by a pair of dies. Secured to the plate 152, adjacent to the bore 154, is a female forming die 200. The die 200 includes a profile 202 for the batten arms and ridge. Beneath the material strip 140 is a male forming die 210. The forming die 210 includes a mating profile form 212 that matches the profile 202 of the die 200. The die 210 moves by appropriate cam action of the die 200 to the left in FIG. 8, as indicated by the large arrow, and it may also pivot somewhat by the same cam action. This pivoting is indicated by the large curved arrow adjacent to the die 210. In the alternative, the bottom die 210 may be disposed directly beneath the upper forming die 200 and accordingly may not need to move.

The spacing or location of the dies 200 and 210 is determined by the placement of the drain holes so that the drain holes will be located at the junctures of the flanges and the arms, as discussed above and as shown in FIGS. 1 and 2, and as may also be appropriate for the other embodiments. The employment of the tunnel drainage configuration of FIG. 6 eliminates the need for the drain hole punches 166 and 168, but the drain tunnels will, of course, be located at the junctures of the flanges and arms, as shown in FIG. 6.

While the drain holes are being punched for the first batten, and the second batten receives its profile, a third batten has been completed and is cut from the continuous roll or sheet of material 140. This cutting or shearing is accomplished by a shear blank 220 and a shear knife 222. The shear knife is also secured to the plate 152 appropriately spaced apart from the forming die 200. The shearing blank 220 is disposed beneath the material 140 and is in an appropriate offset alignment for the shearing or cutting stroke by the knife 222.

Beneath the material 140 and adjacent to the blank 220 is another spring plate 190 and its pin 192 and spring 194. The plate 190 helps to support the material 140 as the knife 222 moves downwardly for the cutting stroke. The location of the cut in the material 140 is indicated by reference numeral 142.

With the completion of the cutting stroke, a finished or completed batten 230 is separated from the material 140. The batten 230 includes a flange 232, an arm 236, with a drain hole 234 at the juncture of the flange and the arm, a flat top ridge 238 and an arm 240. At the juncture of the arm 240 and a flange 244 is a drain hole 242.

It will be understood, of course, that an entire batten, for example, forty eight inches long, with a plurality of aligned drain holes spaced apart along the length of the batten, will be formed substantially simultaneously, and a single cutting or shearing takes place to cut the finished batten from the material. While the forms 200 and 210 are continuous for the length of a batten, and also the shear blank 220 and the shear knife 22 are also continuous, the hole punches, such as the punches 166 and 168, will be appropriately spaced apart along the length of the material 140 and thus along the length of what will become a finished batten upon the completion of the process.

Note that the batten 230 has the profile of the plastic batten 40 of FIG. 3. Obviously, any profile may be made by the simple expediency of changing the dies 200 and 210 to provide the desired profile.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What we claim is:

1. A batten article for securing tiles to a roof comprising in combination:

a first flange;

a first arm extending upwardly from the first flange at an obtuse angle;

a second flange;

a second arm extending upwardly from the second flange at nearly a right angle and to the first arm, the juncture of the first and second arms defining a ridge; and means for draining water through the first flange and first arm and through the second flange and second arm.

2. The batten article of claim 1 in which the means for draining water includes a first drain hole in the first flange and first arm and a second drain hole in the second flange and second arm.

3. The batten article of claim 2 in which the first and second drain holes are aligned with each other.

4. The batten article of claim 1 in which means for draining water includes a first tunnel formed in the first flange and first arm and a second tunnel formed in the second flange and second arm.

5. The batten article of claim 4 in which the first and second tunnels are aligned with each other.

6. The batten article of claim 1 in which the ridge is generally pointed.

7. The batten article of claim 1 in which the ridge is generally flat.

8. The batten article of claim 1 in which the first flange includes a ripple which defines a trough between the ripple and the first arm for catching a nail.

9. The batten article of claim 1 in which the batten is made of metal.

10. The batten article of claim 9 in which the metal has a stucco finish.

11. The batten article of claim 1 in which the batten is made of plastic.

* * * * *